United States Patent [19]

Brangenberg

[11] 4,135,729

[45] Jan. 23, 1979

[54] SKI SAFETY DEVICE

[76] Inventor: Egidius Brangenberg, Riffelstrasse 46, 8100 Garmisch-Partenkirchen, Fed. Rep. of Germany

[21] Appl. No.: 674,740

[22] Filed: Apr. 7, 1976

[30] Foreign Application Priority Data

Apr. 14, 1975 [DE] Fed. Rep. of Germany ..... 2516194

[51] Int. Cl.[2] ..... A63C 11/00

[52] U.S. Cl. ..... 280/11.37 E; 24/221 R

[58] Field of Search ..... 280/11.37 E, 11.37 R, 280/601, 611, 636; 24/221 R, 211; 351/111; 428/131; 301/64 R, 63 DD, 63 DT, 63 PW

[56] References Cited

U.S. PATENT DOCUMENTS

| | | | |
|---|---|---|---|
| 1,809,117 | 6/1931 | Golden | 24/221 R |
| 2,611,624 | 9/1952 | Gurvich | 280/601 |
| 3,295,860 | 1/1967 | Von Hoven | 280/601 |
| 3,407,454 | 10/1968 | Myatt | 24/221 R |
| 3,413,721 | 12/1968 | Pickering | 24/211 R |
| 3,800,369 | 4/1974 | Nikolits | 24/221 R |
| 3,843,202 | 10/1974 | Lacerte | 301/63 PW |
| 3,910,593 | 10/1975 | Schwarz | 280/11.37 E |
| 3,951,425 | 4/1976 | Brangenberg | 280/11.37 E |

FOREIGN PATENT DOCUMENTS

| | | | |
|---|---|---|---|
| 1077640 | 11/1954 | France | 280/611 |

*Primary Examiner*—David M. Mitchell
*Attorney, Agent, or Firm*—Michael J. Striker

[57] ABSTRACT

A ski safety device prevents unintentional crossing of skis during skiing. It has a support plate mountable on an upper surface of a ski, and a frame above the support. A bottom wall of the frame faces the upper side of the support and a layer of elastically compressible material, such as plastic foam material, is interposed between them. The bottom wall of the frame is formed with an elongated opening and the upper side of the bottom wall has at opposite sides of the opening respective depressions which extend outwardly away from the opening. A projection extends upwardly from the support through the opening and is formed with two transverse extensions which enter into the respective depressions when the frame is turned relative to the support from a position in which the elongation of the opening is parallel to that of the extensions to another position in which the two directions of elongation are inclined relative to one another, under simultaneous compression of the elastically compressible material. Thus, the frame is readibly detachably secured to the support and thereby to the ski in which the support is mounted.

14 Claims, 6 Drawing Figures

SKI SAFETY DEVICE

BACKGROUND OF THE INVENTION

This invention relates generally to a ski safety device, and in particular to a device which prevents unintentional crossing of skis during skiing.

Skiers sometimes cross their skis on purpose, i.e., one ski is placed over and crosswise of the other ski. However, if this occurs accidentally, as can happen when the two skis "bump" together for reasons of terrain or for other reasons as a skier is moving, it can cause the skier to take a most unpleasant fall and result in more or less serious injuries.

For this reason it has been proposed in the prior art, for example in German Published Application 23 61 258 and 22 28 084, to provide anti-crossing devices. For various reasons, including storage problems for the skis, it is undesireable to permanently connect these devices with the skis. Therefore, it has been proposed to mount the devices detachably on the skis, so that they can be attached when needed and detached when desired.

However, proposals made in the prior art are relatively complicated as to the instrumentalities required for securing and releasing the devices from the skis. This is undesirable for obvious reasons. In addition, at least some of the prior-art devices provide inadequate damping of impacts which result when one ski bumps the device on the other and which act in direction transversely of the elongation of the skis. Also, in the prior art the separate instrumentalities required to secure the device on the ski, e.g., a pin, lever, or the like, are susceptible to loss.

SUMMARY OF THE INVENTION

Accordingly, it is an object of the invention to provide an improved anti-crossing device for skis which overcomes the disadvantages of the prior art.

A more specific object is to provide such a device which can be secured and released in a much simpler and quicker manner than the devices known from the prior art.

A further object is to provide a device of this type which offers excellent damping of impacts which act transversely of the elongation of the respective skis.

Still another object of the invention is to provide a device of the type under discussion which does not require any mounting components that are susceptible to loss.

In keeping with these objects, and with others which will become apparent hereafter, one feature of the invention resides in a device of the character in question which, briefly stated, comprises a support mountable on an upper surface of a ski; a frame above the support and provided with a bottom wall having a lower side facing the support and with an upper side; a member of elastically compressible material interposed between the support and the lower side of the bottom wall; and means for detachably connecting the frame with the support, comprising an elongated opening in the bottom wall and a pair of pockets in the upper side each extending outwardly from a different longitudinal side of the opening, and a rigid projection extending upwardly from the support and having a terminal section extending through the opening and provided with two portions which project from the terminal section opposite one another and substantially parallel to the support and which are each receivable in one of the pockets.

This construction completely eliminates the need for loss-prone separate mounting instrumentalities, inasmuch as the entire device is composed of merely two separable elements. To mount the frame on the support — and hence on the ski — it is only necessary to so align the elongation of the opening with the elongation of the aligned projecting portions or pins which extend from the terminal section of the projection, that the terminal section with these pins can be inserted through the opening so that the pins become located above the upper side of the bottom wall of the frame. Twisting frame and support relative to one another in their respective planes causes each pin to become wedged into one of the depressions under simultaneous compression of the elastically compressible member, and the connection is firmly established. To effect detachment, the procedure is simply reversed. Only one hand is required to twist the frame.

Relative angular displacement of frame and support is required only through 90°. The relative short extension of the pins results in an only low stress-transmission to the mounting of support to the ski, when transverse forces act upon the device as one ski hits the frame of the device mounted on the other ski. Most of these impacts do, in fact, act in ski-transverse direction; it is therefore advantageous if the pins extend lengthwise of the ski in the final mounted condition of the device, and if the elongation of the opening in the bottom wall of the frame extends transverse of the ski elongation under the same circumstances.

The member of elastically compressible material may, but need not, be of synthetic plastic foam material, e.g., of expanded polyvinyl or polystyrene. This member may either be fixedly connected (e.g., bonded by means of an adhesive or otherwise secured) to the upper side of the support, or else to the lower side of the bottom wall of the frame. It is advantageous if, in either case, a layer of a low-friction material (e.g., polyethylene or polytetrafluoroethylene) is interposed between the elastically compressible member and whichever element of the device to which the member is not fixedly secured, so as to facilitate relative twisting of these elements. It will be evident that if the member is secured to the lower side of the bottom wall of the frame, it must have an aperture in registry with the opening in the bottom wall, to permit passage of the terminal section and the pins.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
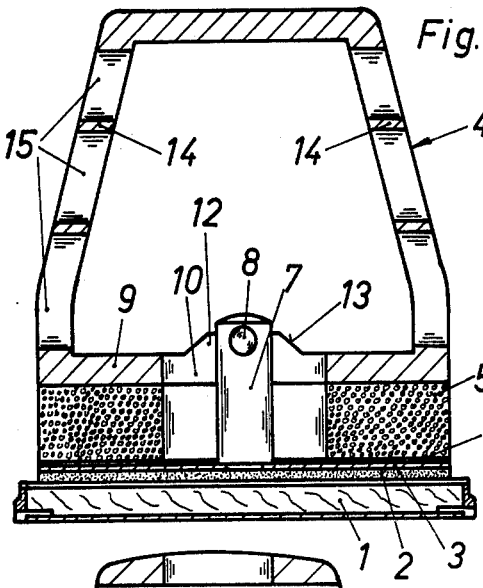
FIG. 1 is a central vertical section through a device according to the invention, mounted on a ski and in operating position.

FIGS. 1–5 show a single, exemplary embodiment of my novel anti-crossing safety device for skis.

The device has a support element 3 of plateshaped configuration which is shown mounted on the upper surface of a ski 1, for example (but not necessarily) by means of a double-stick foam type of the type which is commercially available. An anti-crossing frame 4 is detachably mounted atop the support element 3, and a member 5 of elastically compressible material — e.g., synthetic plastic foam material — is interposed between the elements 3 and 5.

As all of the Figures show, the support element 3 has a projection or pin 7 which is rigid and extends from it in upward direction. The upper free terminal section of this pin is provided with two smaller pins or projections which project to opposite sides and are aligned with one another, being located in a plane parallel to that of the support element 3.

Figure 6:
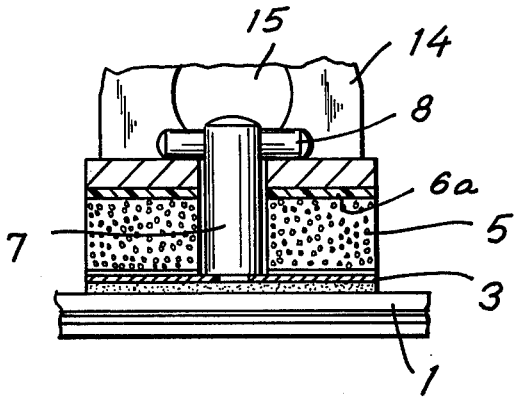

In the particular illustrated embodiment the member 5 is secured — e.g., by adhesive bonding or the like — with the underside of the bottom wall 9 of the frame 4; it has a surface facing the support element 3 and provided with a low-friction layer 6, for example polyethylene or polytetrafluoroethylene. Thus, relative turning of elements 3 and 4 is facilitated due to the low friction between layer 6 and support element 3. It should be understood, incidentally, that the layer could instead be provided on the upper surface of the support element 3 where it would still perform the same function, or that the member 5 could be secured to the upper surface of the support element 3 and could in turn have a layer 6 provided on its surface which would face the underside of the bottom wall 9 of the frame element 4 as shown in FIG. 6.

Figure 5:
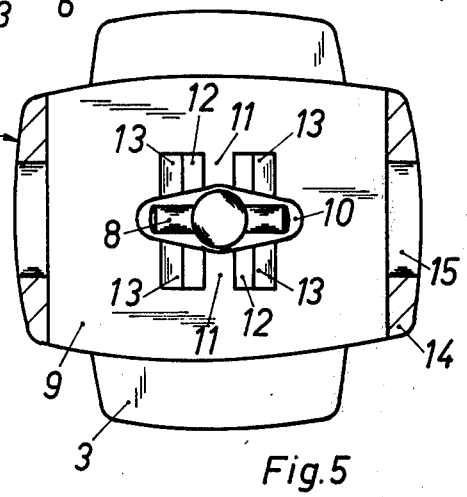
FIG. 5 is a section similar to that of FIG. 3, but showing the frame turned through 90° relative to the support element of the device.

In the illustrated embodiment the bottom wall 9, the member 5 and the layer 6 are all provided with registering non-round openings 10 for passage therethrough of the terminal section of projection 7, which carries the pins 8. The upper surface of the bottom wall 9 is provided at opposite longitudinal sides of the opening 10 with respective pockets for entry of the pins 8; these pockets are in this instance defined by respective pairs of protuberances 12. The sides of the protuberances 12 are inclined (see FIGS. 1 and 3) to form ramps which wedgingly engaged by the pins 8 when the elements 3 and 4 are turned relative to one another through 90° to establish a connection between them, as shown in FIGS. 3 and 5.

It is desirable to reduce the weight and mass of the frame 4 as much as possible, so as not to have them act as a factor influencing ski travel in the event of impacting of the skis upon one another. For this purpose the walls, advantageously the two sidewalls of the frame, may each be provided with one or more cut-outs 15. In the illustrated embodiment the two sidewalls 14 of the frame 4 have round cut-outs 15 which are located one above the other and wherein the diameter of the respective cut-outs decreases from top to bottom of the walls 14. However, different cut-out shapes, numbers and/or sizes may also be chosen. In any case, this assures maximum strength of the sidewalls at a minimum mass and weight.

Figure 2:
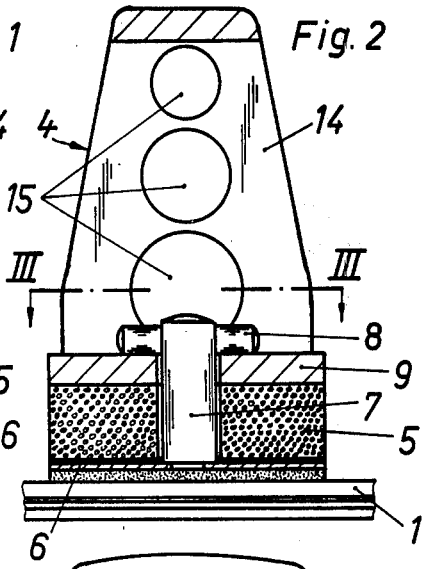
FIG. 2 is a center longitudinal section through the device in FIG. 1.
Figure 3:
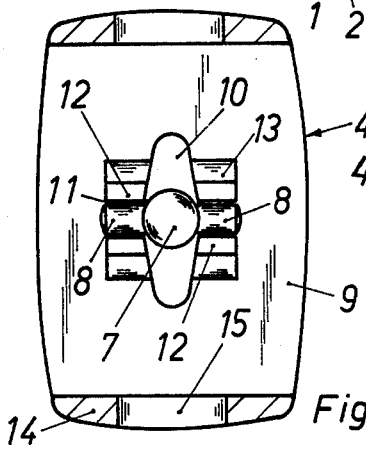
FIG. 3 is a section on line III — III of FIG. 2.
Figure 4:
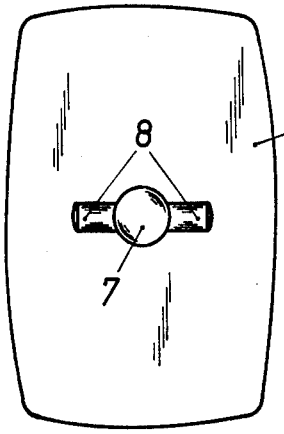
FIG. 4. is a top-plan view of the support element of the device, with the frame omitted for clarity.

FIGS. 1–3 show the device in operative position. To detach the frame element from the support element 3 (and hence from the ski 1) when the device is not being used, it is simply necessary to press down on the frame 4 to effect increased compression of the member 5, and to carry out relative twisting of frame and support element through 90°, until the position shown in FIG. 5 is reached. The frame 4 can then be simply lifted off the support element 3 and the pins 8 will pass through the opening 10 with which they are now in longitudinal registry. The support element 3 is then exposed as shown in FIG. 4.

Conversely, to connect frame element 4 with the support element 3, the procedure is reversed. The frame element 4 is placed onto the support element 3 so that the pins 8 pass through the opening 10 which must, of course, at this time be in longitudinal registry with them. Once this is done (compare FIG. 5) the frame element 4 and the support element 3 are twisted relative to each other through 90°. The downward pressure on frame element 4 need only be slight, since the pins ride up on the ramps 13 and during continued twisting cause compression of the element 5 with little effort on the part of the user. Once the pins 8 reach the pockets 11 and enter them, they are retained therein due to the fact that the material of member 5 expands once the downward pressure exerted by the cooperation of the ramps with the pins is relaxed. The frame element 4 is now non-turnably secured to the support element 3 and the ski 1. Due to the shortness of the pins 8, the frame element 4 may, in effect, be considered as being "cardanically" mounted on the support element 3, as a consideration of FIGS. 1–3 makes clear.

It will be appreciated that the thickness (in veritcal direction) of the member 5 must be so selected that it can be compressed to the extent necessary for the pins to exit from the pockets 11 when the connection between elements 3 and 4 is to be disengaged. Of course, this minimum thickness can be exceeded. However, it can be of advantage if the thickness is so selected that in the operative position (FIGS. 1–3) the member 5 will not be stressed by compression, or only to a slight degree. The reason for this is that the pressure exerted by the tendency of the material of member 5 to expand to its relaxed state, which pressure includes an upwardly acting component that acts in direction towards the wall 9, might tend to exert a lifting action upon the projection 7 via the pins 8 thereof, which might result in, or initiate a loosening of the mounting tape 2.

It is self-evident that if the member 5 is fixed to the support element 3 instead of the frame element 4, the opening in member 5 for passage of the projection 7 need only be large enough to accommodate the projection 7, since the pins 8 never need to pass through it.

It will be understood that each of the elements described above, or two or more together, may also find a useful application in other types of applications differing from the types described above.

While the invention has been illustrated and described as embodied in an anti-crossing device for skis, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for preventing unintentional cross of skis during skiing, comprising a support mountable on an upper surface of a ski; a frame above said support and provided with a bottom wall having a lower side facing said support and with an upper side; a member of elastically compressible material having an upper and a lower surface and being interposed between said support and said lower side of said bottom wall, one of the and lower surfaces of said member being fixedly attached to one of said lower side of said bottom wall and said support; means for detachably connecting said frame with said support, comprising an elongated opening in said bottom wall and a pair of pockets in said upper side each extending outwardly from a different longitudinal side of said opening, and a rigid non-turnable projection extending upwardly from said support and having a terminal section extending through said opening and provided with two portions which project from said terminal section opposite one another and substantially parallel to said support and which are each receivable in one of said pockets in response to turning of said frame relative to said support about an axis coinciding with the elongation of said projection; and means carried by the other of said upper and lower surfaces of said member for facilitating turning of said frame relative to said support.

2. A device as defined in claim 1, wherein said support is a base plate.

3. A device as defined in claim 1, wherein said elastically compressible material is synthetic plastic foam material.

4. A device as defined in claim 1, wherein the elongation of said opening extends normal to the elongation of the ski when said frame is connected to said supports and said portions extend lengthwise of the ski.

5. A device as defined in claim 1, wherein each of said pockets is bounded by two protuberances on said upper side of said bottom wall of said frame.

6. A device as defined in claim 5, wherein said protuberances extend parallel to said pockets and each have one side facing towards and another side facing away from the respective pockets, at least one of said protuberances bounding the respective pocket being formed with a ramp which is upwardly inclined towards the associated pocket at said one side of said one protuberance.

7. A device as defined in claim 1, wherein said frame has two sidewalls provided with cut-outs.

8. A device as defined in claim 1, wherein said frame has two side walls provided with a plurality of different-diameter cut-outs.

9. A device for preventing unintentional crossing of skis during skiing, comprising a support mountable on an upper surface of a ski; a frame above said support and provided with a bottom wall having a lower side facing said support and with an upper side; a member of elastically compressible material interposed between said support and said lower side of said bottom wall, fixed to the latter and having an aperture and a side facing said upper surface; means for detachably connecting said frame with said support, comprising an elongated opening in said bottom wall in registry with said aperture and a pair of pockets in said upper side each extending outwardly from a different longitudinal side of said opening, and a rigid non-turnable projection extending upwardly from said support and having a terminal section extending through said opening and provided with two portions which project from said terminal section opposite one another and substantially parallel to said support and which are each receivable in one of said pockets; and a low-friction layer interposed between said upper surface and said side of said member.

10. A device as defined in claim 9, wherein said layer is of polyethylene.

11. A device for preventing unintentional crossing of skis during skiing, comprising a support mountable on an upper surface of a ski; a frame above said support and provided with a bottom wall having a lower side facing said support and with an upper side; a member of elastically compressible material fixed to said support interposed between the same and said lower side of said bottom wall, said member having a side facing said bottom wall; means for detachably connecting said frame with said support, comprising an elongated opening in said bottom wall and a pair of pockets in said upper side each extending outwardly from a different longitudinal side of said opening, and a rigid non-turnable projection extending upwardly from said support and having a terminal section extending through said opening and provided with two portions which project from said terminal section opposite one another and substantially parallel to said support and which are each receivable in one of said pockets; and a low-friction layer interposed between said side and said bottom wall.

12. A device as defined in claim 11, wherein said layer is polyethylene.

13. A device for preventing unintentional crossing of skis during skiing, comprising a first element mountable on an upper surface of a ski; a second element about said first element, one of said elements having an opening facing the other element; a rigid projection extending from said other element and being turnable with but not relative to the same, said projection having a terminal section distal from said other element and extending into said opening; cooperating coupling means on said terminal section and in said one element and operative for engaging with each other so as to detachably connect said elements, in response to twisting displacement of said elements relative to one another in parallel superposed planes and under simultaneous pressing of said elements towards one another; resiliently compressible means having an upper and a lower surface and permanently urging said elements apart from each other in response to the exertion of the pressure which urges said elements towards one another, one of said upper and lower surfaces of said resilient means being fixedly attached to one of said first and second elements; and means on the other of said upper and lower surfaces for facilitating said twisting displacement of said elements relative to one another.

14. A device for preventing unintentional crossing of skis during skiing, comprising a support mountable on an upper surface of a ski; a frame above said support and having a bottom wall facing said support; a member of elastically compressible material having an upper and a lower surface and being located between said support and said bottom wall, one of the upper and lower surfaces of said member being fixedly attached to one of said support and said bottom wall; means for detachably connecting said frame with said support in response to twisting displacement of said support and frame relative to one another in parallel superposed planes and under simultaneous compression of said member; and means on the other of said upper and lower surfaces of said member for facilitating said twisting displacement of said support and frame relative to one another.

* * * * *

UNITED STATES PATENT AND TRADEMARK OFFICE

CERTIFICATE OF CORRECTION

PATENT NO. : 4,135,729
DATED : January 23, 1979
INVENTOR(S) : Egidius Brangenberg It is certified that error appears in the above-identified patent and that said Letters Patent are hereby corrected as shown below:

Column 5, line 3, change "cross" to -- crossing --;

line 11, before "and" insert -- upper --.

Column 6, line 31, change "about" to -- above --.

Signed and Sealed this

*Sixth* Day of *May 1980*

[SEAL]

*Attest:*

SIDNEY A. DIAMOND

*Attesting Officer*

*Commissioner of Patents and Trademarks*